US007086235B2

(12) United States Patent
Von Arx et al.

(10) Patent No.: US 7,086,235 B2
(45) Date of Patent: Aug. 8, 2006

(54) CASCADE IGNITION OF CATALYTIC COMBUSTORS

(75) Inventors: Alan V. Von Arx, Northridge, CA (US); Mark D. Horn, Granada Hills, CA (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/724,555

(22) Filed: Nov. 26, 2003

(65) Prior Publication Data

US 2005/0109036 A1 May 26, 2005

(51) Int. Cl.
*F02C 7/22* (2006.01)
*F02C 7/26* (2006.01)

(52) U.S. Cl. ..... 60/777; 60/723; 60/39.822

(58) Field of Classification Search ..... 60/777, 60/723, 737, 738, 730, 736, 39.822, 266, 60/722; 431/11, 207, 208, 7, 170, 268, 243, 431/210–212, 215–217
See application file for complete search history.

(56) References Cited

U.S. PATENT DOCUMENTS 4,072,007 A * 2/1978 Sanday ..... 60/723
4,445,570 A * 5/1984 Retallick ..... 166/59
4,731,989 A * 3/1988 Furuya et al. ..... 60/775
4,754,607 A 7/1988 Mackay
4,755,360 A 7/1988 Dickey et al.
4,870,824 A * 10/1989 Young et al. ..... 60/723
5,000,004 A * 3/1991 Yamanaka et al. ..... 60/723
5,140,812 A 8/1992 Cornelison et al.
5,149,261 A * 9/1992 Suwa et al. ..... 431/207
5,250,489 A * 10/1993 Dalla Betta et al. ..... 502/262
5,309,637 A 5/1994 Moriarty
5,319,929 A 6/1994 Cornelison et al.
5,431,017 A * 7/1995 Kobayashi et al. ..... 60/723
5,468,143 A * 11/1995 Weber et al. ..... 431/243
5,512,250 A * 4/1996 Betta et al. ..... 422/173
5,624,252 A * 4/1997 Charles et al. ..... 431/7
5,833,450 A * 11/1998 Wunning ..... 431/215
5,944,504 A * 8/1999 Tanaka et al. ..... 431/11
6,116,014 A * 9/2000 Dalla Betta et al. ..... 60/777
6,158,222 A 12/2000 Retallick
6,205,768 B1 * 3/2001 Dibble et al. ..... 60/39.511
6,223,537 B1 5/2001 Lipinski et al.
6,269,625 B1 8/2001 Dibble et al.
6,415,600 B1 7/2002 Lejon
6,588,213 B1 * 7/2003 Newburry ..... 60/777
6,594,999 B1 * 7/2003 Mandai et al. ..... 60/722
6,772,594 B1 * 8/2004 Nishida et al. ..... 60/737
6,775,989 B1 * 8/2004 Bandaru et al. ..... 60/777
6,796,129 B1 * 9/2004 Yee et al. ..... 60/777
2002/0015931 A1 * 2/2002 Smith et al. ..... 431/268
2003/0192318 A1 * 10/2003 Sprouse et al. ..... 60/777
2003/0192319 A1 * 10/2003 Sprouse et al. ..... 60/777
2004/0003598 A1 * 1/2004 Farhangi ..... 60/777
2004/0035114 A1 * 2/2004 Hayashi et al. ..... 60/737
2004/0185398 A1 * 9/2004 Butler ..... 431/2
2004/0187498 A1 9/2004 Sprouse et al.
2004/0187499 A1 9/2004 Farhangi et al.

* cited by examiner

*Primary Examiner*—William Rodriguez

(57) ABSTRACT

The present embodiment relates to a catalytic combustor for reducing the pollutant emissions of combustion. The catalytic combustor described herein employs a novel heat exchange system for rapidly and economically bringing the combustor to a temperature wherein catalytic combustion may occur with minimal production of toxic products.

21 Claims, 3 Drawing Sheets

CASCADE IGNITION OF CATALYTIC COMBUSTORS

BACKGROUND OF THE INVENTION

1. Field of the Invention

This invention relates generally to catalytic combustors for use with gas turbines. More specifically, the invention provides a heat exchange system for rapidly bringing the temperature of a combustor to a level where efficient catalytic reactions may occur.

2. Discussion of the Related Art

Catalytic combustion makes possible extremely low emissions of pollutants from gas-powered turbine generators, particularly of oxides of nitrogen ($NO_x$). Properly designed catalytic combustors can deliver both low $NO_x$ and low carbon monoxide (CO) emissions, in contrast to conventional combustors which may suffer from high $NO_x$ and/or high CO.

Gas turbine systems have been previously proposed in which an air/fuel mixture is compressed by a compressor, and then reacted in a catalytic combustor. For example, U.S. Pat. No. 4,754,607 describes a self-contained energy center or cogeneration system which converts chemical energy into mechanical, electrical, and heat energy. The fuel, preferably a gaseous fuel such as natural gas, is mixed with air in a mixer, and then the resulting mixture enters the compressor. The compressor compresses the air/fuel mixture and outputs the compressed mixture to the cold side of a heat exchanger in which the mixture becomes heated. The heated, high-pressure mixture is then delivered to the combustion chamber of a catalytic combustor. The resulting products of combustion are directed to the inlet of an expansion turbine mounted on the compressor shaft. After powering the turbine, the hot combustion gases are directed through the hot side of the heat exchanger, whereupon those gases supply the heat which is transferred to the cooler air/fuel mixture passing through the cold side of the heat exchanger. In this case, the turbine drives an electric generator mounted on the compressor shaft for producing electric power.

The use of a catalytic combustor offers the advantage that all of the fuel can be oxidized therein, resulting in ultra low NOx emissions and low CO and UHC (unburned hydrocarbon) levels. However, methods and apparatus previously described do not optimize heat exchange. Therefore, there is a need for a low-cost, reliable method to start the combustion process to bring the turbine up to operating conditions.

Thus, it is an object of the preferred embodiment to meet these and other needs.

SUMMARY OF THE INVENTION

As described herein, in one preferred embodiment are methods and apparatus for exchanging heat in a catalytic combustor comprising at least one air passage, at least one premixed fuel/air passage sharing a common wall with the at least one air passage, and a means for heating at least one side of the combustor to a temperature wherein combustion is initiated and propagated throughout the combustor in a cascade reaction. The at least one air passage and at least one premixed fuel/air passage may be formed by any means such as, for example, plates, tubes, and products of direct casting. The plates, tubes, product of direct casting, and/or other wall forming means may be arranged in a honeycomb formation.

In another embodiment a catalytic combustor for gas turbines is described wherein the catalytic combustor comprises a plurality of layered plates, a catalyst on the plates, a plurality of air passages formed from the plates, a plurality of premixed fuel/air passages formed from the plates, a means for heating at least one side of the combustor wherein the means for heating warms a first layer of plates such that the energy of activation for the catalyst is achieved, a second layer of plates which is heated by the first layer of plates such that a chain reaction ensues wherein the energy of activation is overcome for each successive layer of the plurality of plates.

In another embodiment a catalytic combustor for gas turbines is described wherein the catalytic combustor comprises a plurality of layered tubes, a catalyst on the tubes, a plurality of air passages formed from the tubes, a plurality of premixed fuel/air passages formed from the tubes, a means for heating at least one side of the combustor wherein the means for heating warms a first layer of tubes such that the energy of activation for the catalyst is achieved, a second layer of tubes which is heated by the first layer of tubes such that a chain reaction ensues wherein the energy of activation is overcome for each successive layer of the plurality of tubes.

In yet another embodiment, a method of activating a catalytic combustor for use in gas turbines is described wherein the steps include applying heat to at least one side of the combustor for heating the air located in a first layer of air passages, heating the plates which form a side of the first layer of air passages by way of the heated air, blowing the heated air through the first layer of air passages, redirecting the heated air into a layer of premixed fuel/air passages, heating the plates which form a side of the premixed fuel/air passages by way of the heated air, providing fuel to said premixed fuel/air passages wherein combustion occurs, directing the resulting thermal energy products into a turbine to produce power while thermal energy from the combustion process heats incoming air in successive layers.

BRIEF DESCRIPTION OF THE DRAWINGS

The above mentioned and other objects and features of the preferred embodiment and the manner of attaining them will become apparent, and the invention itself will be best understood by reference to the following description of the embodiment of the invention in conjunction with the accompanying drawings, wherein.

DETAILED DESCRIPTION OF THE PREFERRED EMBODIMENTS

Figure 1:
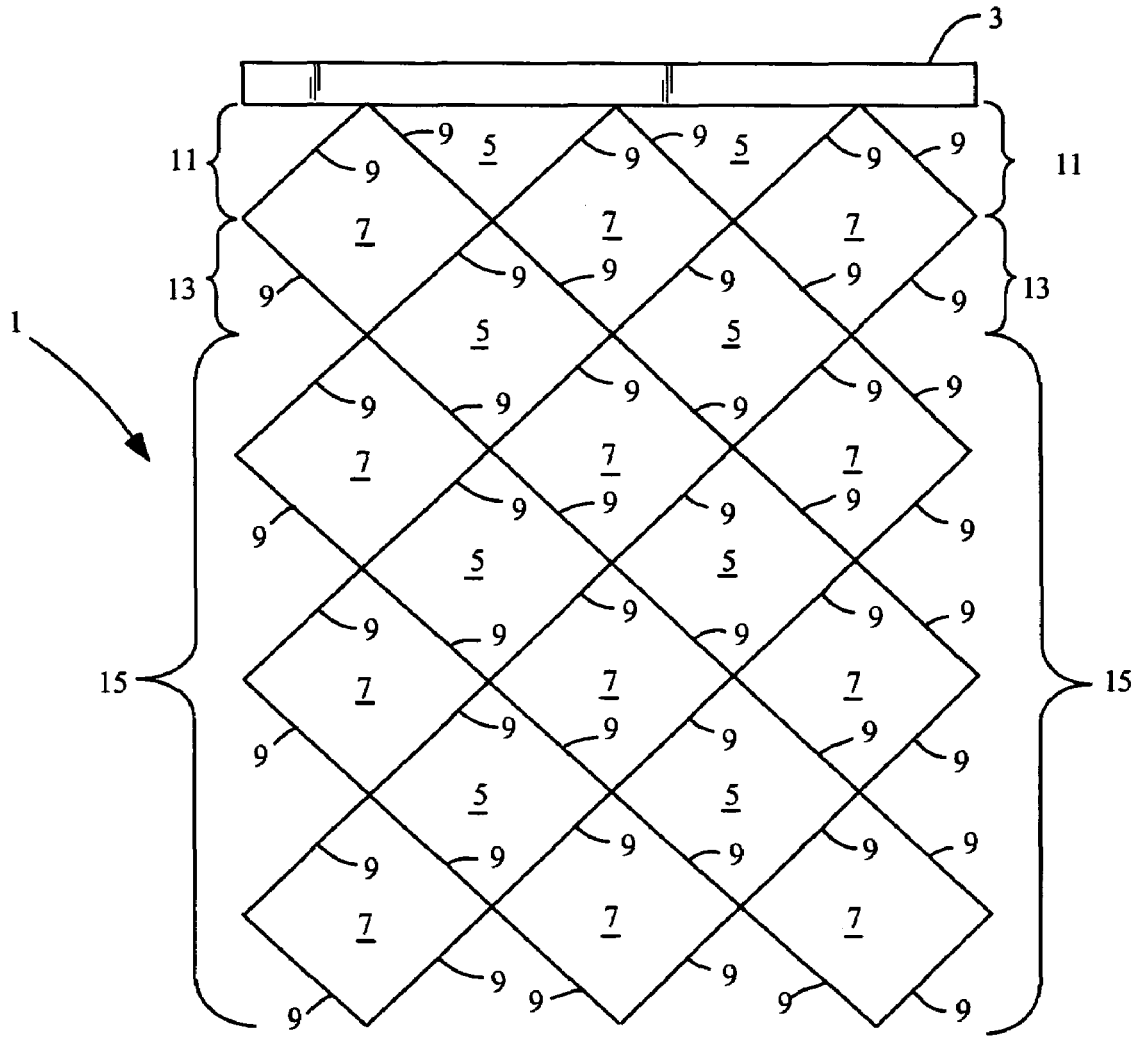
FIG. 1 is a two-dimensional representation of a catalytic combustor having multiple channels through which air and fuel flow.

The following description is the best mode presently contemplated for practicing the invention. This description is not to be taken in a limiting sense, but is made merely for the purpose of describing the general principles of the invention. The scope of the invention should be ascertained with reference to the issued claims. In the description that follows, like numeral or reference characters will be used to refer to like parts or elements throughout.

The catalytic combustors and methods thereof, as described herein, are useful for lowering emissions of pollutants such as, for example, $NO_x$s and CO. However, because the chemical reactions that allow formation of non-toxic emissions including $CO_2$, $N_2$, $O_2$, and water occur at relatively high temperatures, the catalytic combustor described herein utilizes a heating element (i.e. heating means), or comparable apparatus and/or method thereof, to initially bring at least a local area of the combustor to a temperature wherein catalytic combustion may occur. Furthermore, the combustor described herein is advantageously engineered so rapid heat exchange occurs throughout the combustor so that catalytic conversion may occur in an efficient manner with a minimum of start up energy (i.e. heat) required. The heat exchange system as described herein utilizes chain reaction type ignition wherein the energy of activation for the catalyst is achieved at a first layer of plates and then further propagated to succeeding layers of plates (including a second layer of plates) throughout the combustor in a cascade reaction. The methods and apparatuses described herein represent reliable and cost-effective solutions for bringing a catalytic combustor up to operating conditions rapidly.

Referring now to the drawings, the features and embodiments are now further described. In FIG. 1 a two-dimensional representation of a catalytic combustor 1 is depicted. Shown are the combustor 1, a heating element 3, air passages (or channels) 5, premixed fuel/air passages (or channels) 7, plates 9, a first layer of plates 11, a second layer of plates 13, and succeeding (or subsequent) layers of plates 15.

The combustor 1 is comprised of a plurality of air channels 5 and a plurality of premixed fuel/air channels 7. The air channels 5 and fuel channels 7 are formed by situating the plates 9 such that the air channels 5 and premixed fuel/air channels 7 alternate. For example, one side of a plate 9 may form a wall of an air channel 5 as well as a wall of a premixed fuel/air channel 7 on the other side. The formation of the plurality of air channels 5 and premixed fuel/air channels 7 by way of a plurality of plates 9 may form a structure resembling a "honeycomb" such as is the case in FIG. 1.

The plates 9 are preferably corrugated. A catalyst, or mixture of catalysts, such as, for example, platinum, rhodium, and/or palladium is applied to the premixed fuel/air passage side of plates 9. However, any catalyst useful for catalytic combustion may be used. The catalyst may be coated, covered, infused, or in any other way applied to the plates 9.

A heating element 3 is placed on at least one side of the combustor 1. As shown in FIG. 1, the heating element 3 is placed at the top of the combustor 1. The heating element 3 increases the local temperature of the combustor 1 such that the air in the nearest air channels 5 is heated. As the temperature in the air channels 5 nearest the heating element 3 is increased, this heated air enters the first layer of the premixed fuel/air channels 7 at a temperature sufficient to enable catalytic combustion within the passage. The thermal energy released by combustion subsequently warms the adjacent air passages 5. As the air temperature entering the next row of premixed fuel/air passages 7 increases to the point that combustion can take place, catalytic combustion is thus enabled for the next row in the array. This process repeats itself across the entire array until all elements are combusting and generating enough thermal energy for the air heating and catalytic combustion process to be self-sustaining.

Although the walls of the air passages 5 and premixed fuel/air passages 7 are shown as plates 9 in FIG. 1, it should be understood that the walls may be of any means to delineate air passages 5 from premixed fuel/air passages 7, such as, for example, tubes and products of direct casting. Additionally, although the first layer of plates 11 are shown at the top of the combustor 1 nearest the heating element 3, it should be understood that the first layer of plates (or tubes) 11 may be positioned anywhere throughout the combustor 1. The only requirement for a first layer of plates (or tubes) 11 is that they are heated prior to a second layer of plates (or tubes) 13. As such, a second layer of plates (or tubes) 13 may be positioned anywhere throughout the combustor 1 so long as the second layer of plates (or tubes) 13 is adjacent to a first layer of plates (or tubes) 11.

The heating element 3 may be any heating means for increasing the temperature of the air channels 5 nearest the heating element 3 and/or the first layer of plates 11. Examples of heating elements include conventional electric heaters and gas heaters. The air in the initial, or starting air channels 5 may also be heated directly through partial combustion of the air and fuel either externally or within the "starting" air channel 5.

Figure 2:
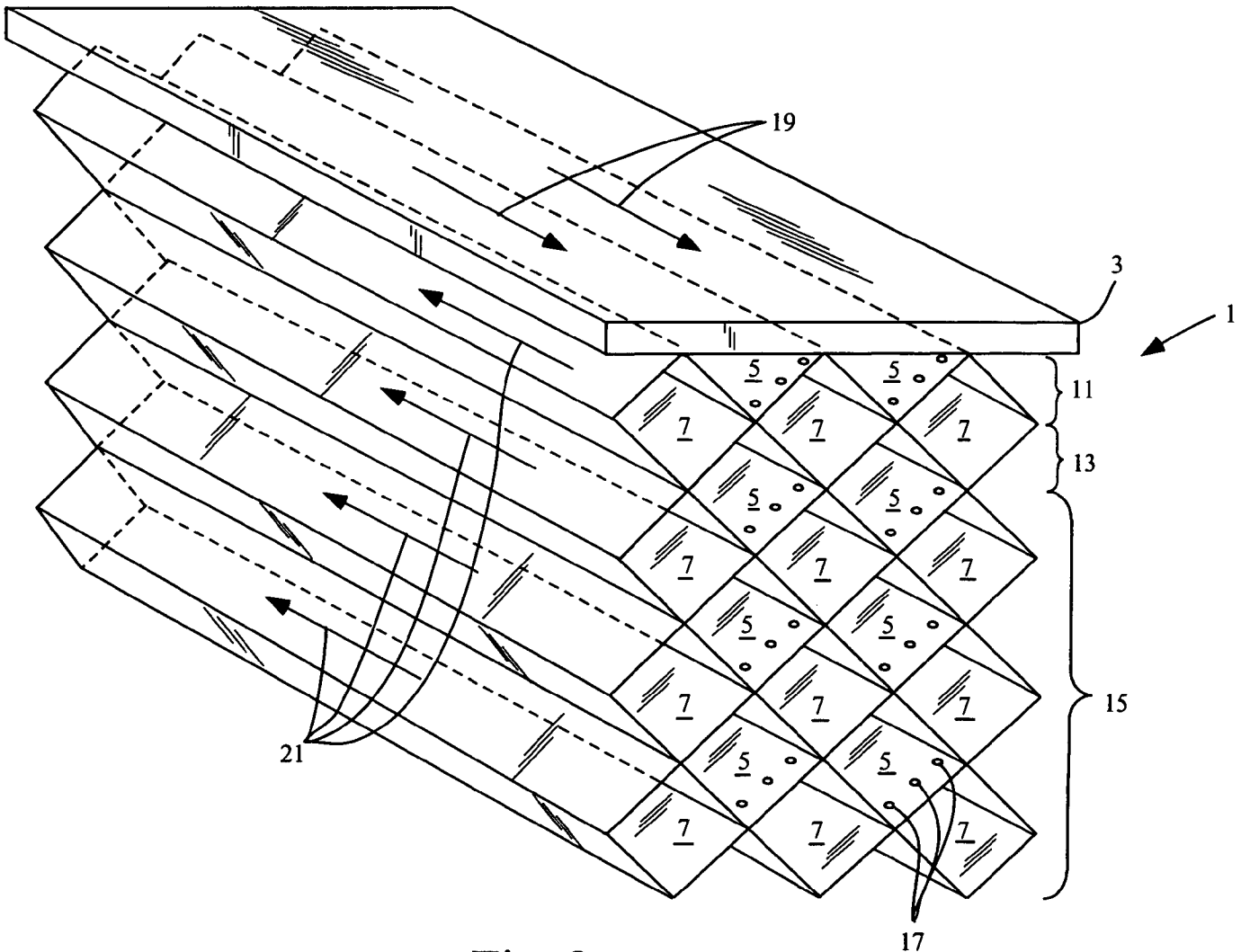
FIG. 2 is a transparent, three-dimensional representation of the catalytic combustor of FIG. 1 showing flow directions and redirecting holes.

Turning now to FIG. 2, a three-dimensional representation of the catalytic combustor of FIG. 1 is shown. Depicted in FIG. 2 are the combustor 1, a heating element 3, air channels 5, premixed air/fuel channels 7, a first layer of plates 11, a second layer of plates 13, subsequent (or succeeding) layers of plates 15, redirecting holes 17, air flow (first) direction 19, and fuel flow (second) direction 21.

Although FIG. 2 is shown in transparent form with open air channels 5 and premixed air/fuel channels 7 for clarity purposes, it should be understood that in practice the air channels 5 and fuel channels 7 are capped with, for example, a sheet of metal. Therefore, the air channels 5 and fuel channels 7 form a semi-closed system wherein air from a compressor (not shown) is blown into air channels 5 and then is redirected into fuel channels 7 by way of redirecting holes 17. After traveling through an air channel 5 and a fuel channel 7, the air and resulting combustion products exit the combustor 1.

The air channels 5 carry air discharged from the compressor (not shown) in a first direction 19. After the compressed air exits the air channels 5 by way of redirecting holes 17 at the end of air channels 5, the air is mixed with fuel to form a lean mixture. Then, the lean mixture, i.e. air plus fuel, is redirected into the fuel channels 7 in a second direction 21. As shown in FIG. 2 the air flow 19 direction is in an opposite direction of the fuel flow direction 21. After the lean air flows through the fuel channels 7 and is catalytically combusted, the combustion products are directed out of the combustor and into the turbine feed duct (not shown) in the turbine feed duct where additional fuel injection and combustion may occur.

At start up, the compressor (not shown) is rotated by a generator (not shown) because there is no high pressure or hot combustion gas to drive the turbine motors. Therefore, the inlet to the catalytic combustor will be at lower pressure and hence, a lower temperature. Thus, at start up, the air entering the air channels 5 will be approximately 200° F. The heating element 3 placed on one or more sides of the combustor 1 increases the temperature of the air in air channels 5 nearest the heating element 3 (i.e. first layer of air channels). The heated air will in turn heat the first layer of plates 11, which demarcate a first wall of the air channels 5. After the locally heated air from the air channels 5 nearest the heating element 3 (i.e. first layer of air channels) mixes with the fuel and air from other air channels, the conditions will be hot enough to initiate a combustion rate that will further heat up the second layer of plates 13, which demarcate at one side air channels 5 and on the other side fuel channels 7. When the second layer of plates 13 is hot enough to start combustion (i.e. approximately 900° F.), the process repeats itself and progresses (or propagates) to the subsequent layers of plates 15, such that in a cascade fashion successive layers of plates 9 will ignite.

The at least one side of the combustor is heated to at least a temperature wherein combustion may occur; however, any temperature suitable to cause combustion and thus, catalytic conversion, is anticipated. Therefore, any temperature at or above the energy of activation of a particular catalyst may be utilized in the present embodiment.

Under normal operation, the air discharged from the compressor is at a temperature between about 600° F. and 700° F. and at approximately 250 PSI. As heat is applied by the heating element 3 to at least one side of the combustor 1, the air in the air channels 5 nearest the heating element 3 (i.e. first layer of air channels) is increased to about 900° F. to 1000° F. The hot air from the air channels 5 nearest the heating element (i.e. first layer of air channels) is mixed with fuel from a fuel injector (not shown) and redirected into fuel channels 7 where the combination of air temperature, plate 9 temperature, and lean mixture is high enough to maintain a reaction rate wherein catalytic conversion may occur (i.e. a temperature wherein the energy of activation for the particular catalyst or catalysts used is reached).

Because the catalytic combustor 1 of the preferred embodiment only requires a small amount of applied heat to begin the combustion process, a thermocouple (not shown) may be advantageously added to the combustor 1 near the first layer of plates 11. The thermocouple (not shown) may be used to shut off power to the heating element 3 once the temperature of the first layer of plates 11 is sufficient to sustain combustion. Any type of temperature measure device may be used in conjunction with the present embodiment.

Figure 3:
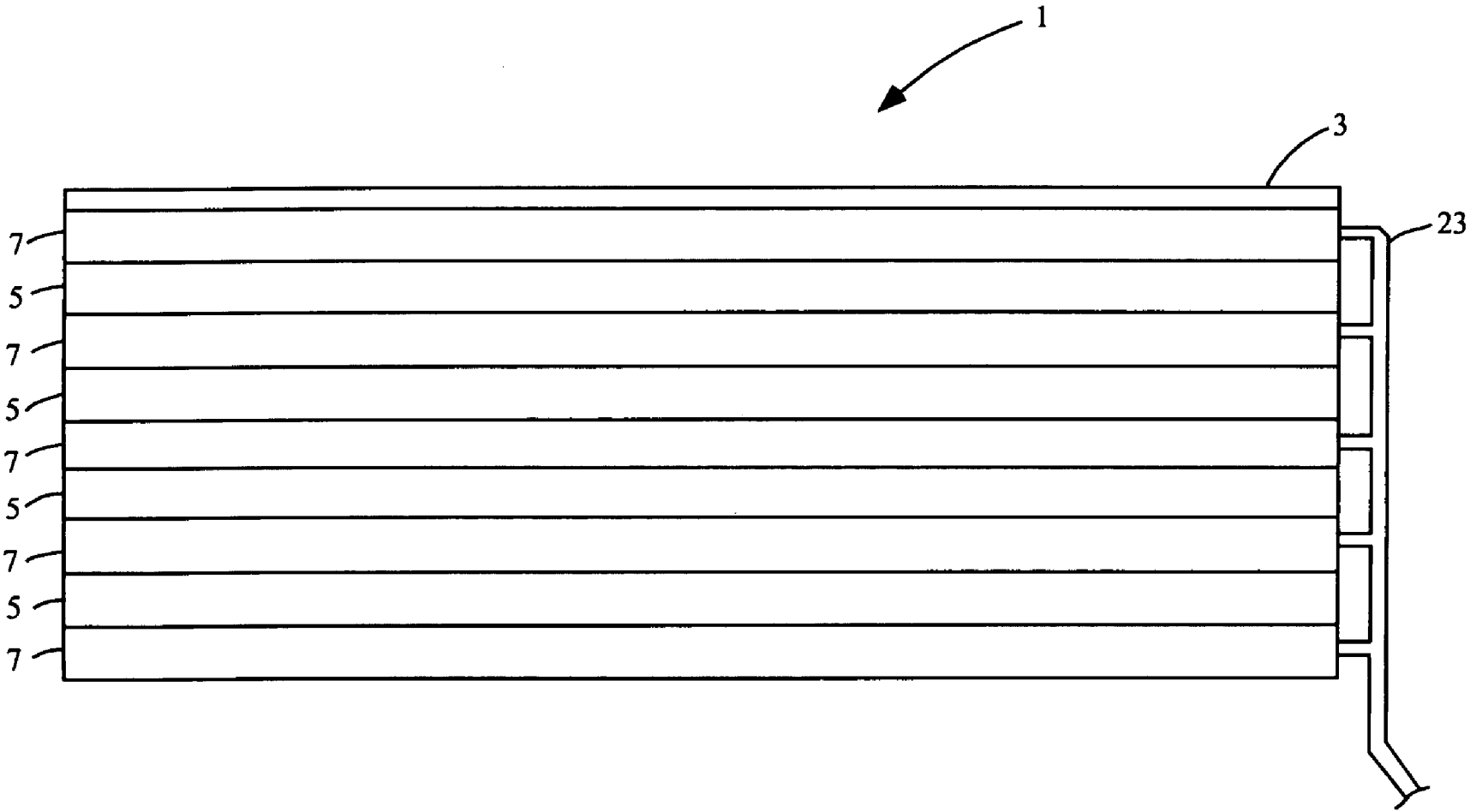
FIG. 3 is a side view depiction of the catalytic combustor of FIG. 1 showing a fuel injector for providing fuel to the premixed fuel/air channels.

Looking now to FIG. 3, a side view of the catalytic combustor of FIG. 1 is provided. Shown are the combustor 1, heating means 3, air channels 5, fuel channels 7, and fuel injector 23.

As shown in FIG. 3, fuel channels 7 are coupled with a fuel injector 23 to at least one end. The fuel injector 23 provides fuel to the fuel channel 7 such that mixing with the heated air and catalytic combustion may occur therein.

The methods and apparatuses described herein may be used to modify any type of known combustor for rapid heat exchange and/or efficient conversion of pollutants to non-toxic material.

All references cited herein are incorporated by reference.

What is claimed is:

1. A catalytic combustor for gas turbines comprising:

a plurality of plates defining at least one first air passage, at least one second air passage, and a plurality of premixed fuel/air passages adjacent to the first and second air passages;

a catalyst within the plurality of premixed fuel/air passages; and a means for heating in thermal contact with at least one first air passage, wherein said means for heating warms air within the at least one first air passage to a predetermined temperature sufficient to initiate catalytic combustion within at least one premixed fuel/air passage; and wherein the premixed fuel/air passages are in thermal contact with the air passages such that air within at least one second air passage is warmed to said predetermined temperature by said premixed fuel/air passages.

2. The catalytic combustor of claim 1 wherein said plates are corrugated.

3. The catalytic combustor of claim 1 wherein said catalyst is any of the group consisting of rhodium, platinum, and palladium.

4. The catalytic combustor of claim 1 wherein said means for heating is any of the group consisting of an electric heater, a gas heater, and direct partial combustion of incoming air.

5. The catalytic combustor of claim 1 wherein said predetermined temperature is in the range of 900° F. and 1000° F.

6. The catalytic combustor of claim 1 wherein said combustor reduces the formation of any of the group consisting of CO and $NO_x$.

7. The catalytic combustor of claim 1 wherein said plates are adapted to redirect air from each air passage to an adjacent premixed fuel/air passage.

8. The catalytic combustor of claim 1 further comprising a temperature measurement device.

9. A method of activating a catalytic combustor for gas turbines comprising the steps of:

blowing air through a plurality of air passages, said blown air having a first temperature;

providing fuel to a plurality of fuel/air passages;

redirecting said blown air into at least one premixed fuel/air passage;

within less than an entirety of the plurality of air passages, heating said blown air to a second temperature sufficient to initiate catalytic combustion of said fuel and a catalyst within the at least one premixed fuel/air passage with the redirected air; and transferring heat generated by the catalytic combustion to at least one air passage through which air is blown at the first temperature to heat said blown air to said second temperature.

10. The method of claim 9 wherein said plates are corrugated.

11. The method of claim 9 wherein the premixed fuel/air sides of said plates are coated with a catalyst.

12. The method of claim 9 wherein said catalyst is any of the group consisting of rhodium, platinum, and palladium.

13. The method of claim 9 wherein said second temperature is in the range of 900° F. and 1000° F.

14. The method of claim 9 wherein the formation of any of the group consisting of CO and $NO_x$ is reduced.

15. A catalytic combustor for gas turbines comprising:

a plurality of tubes forming at least one first air passage, at least one second air passage, and a plurality of premixed fuel/air passages adjacent to the plurality of air passages; and a means for heating in thermal contact with at least one first air passage, wherein said means for heating warms air within at least one first air passage to a predetermined temperature sufficient to initiate catalytic combustion within at least one premixed fuel/air passage, wherein the premixed fuel/air passages are in thermal contact with the air passages such that air within at least one second air passage is warmed to said predetermined temperature.

16. The catalytic combustor of claim 15 wherein said catalyst is any of the group consisting of rhodium, platinum, and palladium.

17. The catalytic combustor of claim 15 wherein said means for heating is any of the group consisting of an electric heater, a gas heater, and direct partial combustion of incoming air.

18. The catalytic combustor of claim 15 wherein said predetermined temperature is in the range of 900° F. and 1000° F.

19. The catalytic combustor of claim 15 wherein said combustor reduces the formation of any of the group consisting of CO and $NO_x$.

20. The catalytic combustor of claim 15 wherein said tubes are adapted to redirect air from each air passage to an adjacent premixed fuel/air passage.

21. The catalytic combustor of claim 15 further comprising a temperature measurement device.

* * * * *